US010717171B2

(12) United States Patent
Truglio

(10) Patent No.: US 10,717,171 B2
(45) Date of Patent: Jul. 21, 2020

(54) EMRID ELECTROMAGNETIC PICKUP TOOL

(71) Applicant: Francis Gerard Truglio, Spotsylvainia, VA (US)

(72) Inventor: Francis Gerard Truglio, Spotsylvainia, VA (US)

( * ) Notice: Subject to any disclaimer, the term of this patent is extended or adjusted under 35 U.S.C. 154(b) by 0 days.

(21) Appl. No.: 15/927,169

(22) Filed: Mar. 21, 2018

(65) Prior Publication Data

US 2018/0304447 A1 Oct. 25, 2018

Related U.S. Application Data

(60) Provisional application No. 62/474,284, filed on Mar. 21, 2017.

(51) Int. Cl.
*B25B 11/00* (2006.01)
*E01H 1/14* (2006.01)

(52) U.S. Cl.
CPC ..... *B25B 11/002* (2013.01); *E01H 1/14* (2013.01)

(58) Field of Classification Search
CPC .... B25B 11/002; B25B 23/18; B25J 15/0608; B66C 1/04; H01F 7/0257; H01F 7/206; H01F 2007/208; E01H 1/14
See application file for complete search history.

(56) References Cited

U.S. PATENT DOCUMENTS 2,729,494 A 1/1956 Trowbridge
3,019,845 A 2/1962 Mayall
3,582,123 A 6/1971 Kyser
4,820,262 A 4/1989 Finney
5,428,484 A 6/1995 Baker
5,799,999 A 9/1998 Schneider et al.
5,999,074 A * 12/1999 Coleman, Jr. ..... H01F 7/0257 294/65.5
6,056,339 A 5/2000 Berger
D446,701 S * 8/2001 Coleman, Jr. ..... D8/14
7,052,155 B2 * 5/2006 Gavin ..... F21V 33/0084 294/65.5
8,054,378 B2 * 11/2011 Kao ..... H04N 5/2252 348/373
8,162,363 B2 * 4/2012 Wang ..... B25B 11/002 294/210
8,210,584 B2 * 7/2012 Hiltz ..... B62D 53/0857 294/175
8,544,918 B1 * 10/2013 Feringa ..... H01F 7/206 294/190
9,355,768 B1 * 5/2016 Scherban ..... H01F 7/0257
2005/0017526 A1 * 1/2005 Arrotta ..... B25B 9/00 294/65.5

FOREIGN PATENT DOCUMENTS

CN 204143060 2/2015
CN 204143060 U * 2/2015
JP 2009268041 A * 11/2009

* cited by examiner

*Primary Examiner* — Stephen A Vu

(57) ABSTRACT

An electromagnetic pickup and inspection tool/device is provided for locating, and the recovery of, metallic, and uniquely, nonmetallic objects, with a unique attachable gripping device, from confined spaces, such as engine compartments. Additional unique features include the use of LED illumination for dark areas and a WIFI micro video camera for enhanced search and inspection capabilities.

14 Claims, 6 Drawing Sheets

Figure 2 Attachable Gripper

Cutaway side view shown with electromagnet power off

Gripper External Views

MICRO 5mm Adjustable Video Camera & Mount

Figure 6 Dual Prong Gripper
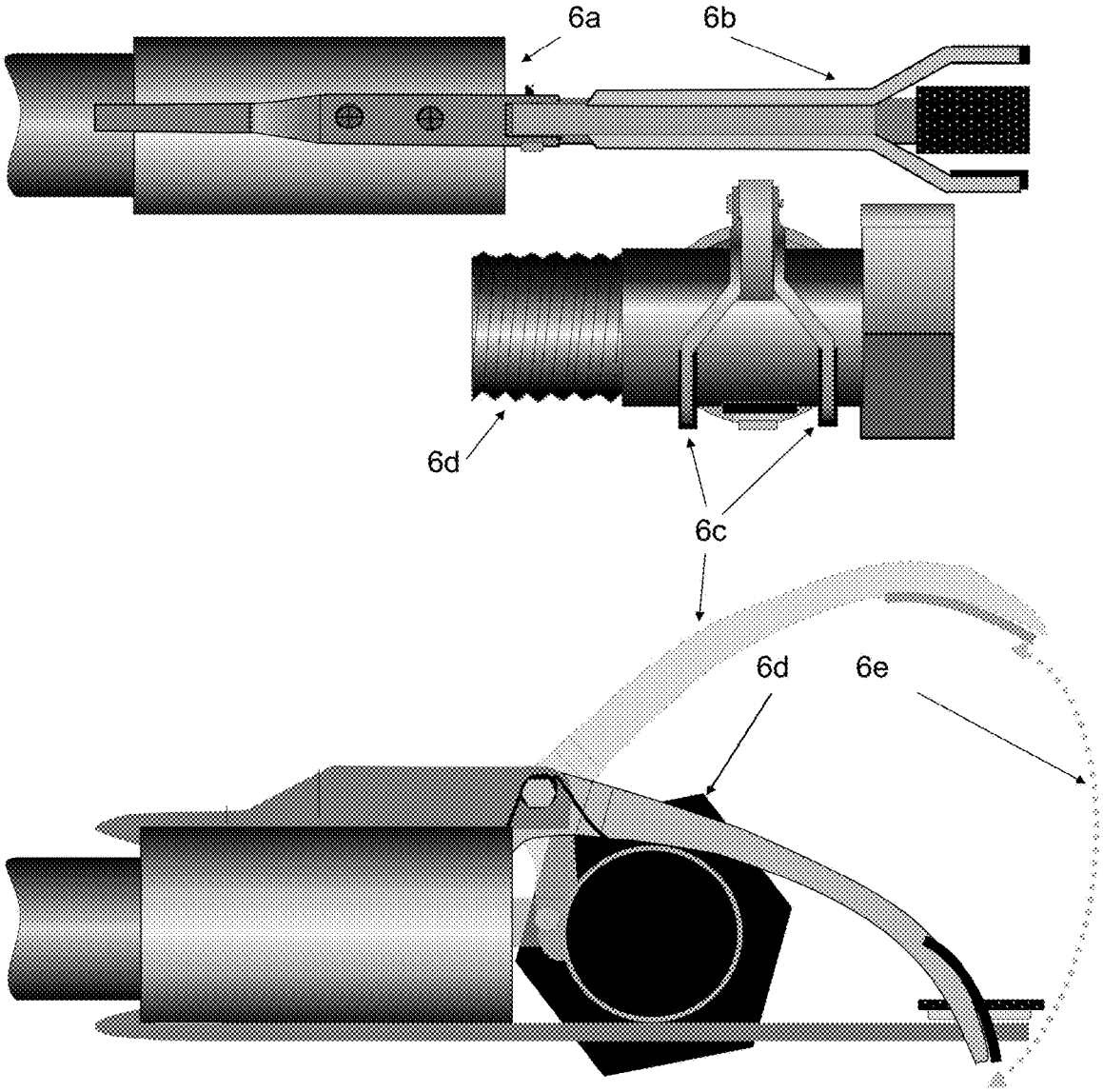

EMRID ELECTROMAGNETIC PICKUP TOOL

BACKGROUND OF THE INVENTION

1. Field of the Invention

The invention relates to magnetic and specifically, electromagnet pickup tools of the type used for picking up ferrous objects, such as screws, nuts and the like, from relatively inaccessible locations.

2. Description of the Related Art

It is known that current pickup/recovery tools utilize various types of permanent Magnets. As such, they can be exceedingly difficult to maneuver. Whereas, permanent Magnet based tools can and will adhere to any ferrous object within reach of its magnetic field; making recovery of the desired object, difficult and/or impossible to achieve. One such type of tool includes an elongated, flexible shaft, having a handle at one end and provided with a magnet at the other end. The magnet may be a permanent magnet or it may be an electromagnet, powered by a suitable power supply means, such as batteries, which may be contained in the handle of the tool. It is known to provide electromagnetic devices with conductive sleeves or outer pole pieces to provide a magnetic path for the flux lines, thereby concentrating the flux lines at a desired location, such as at the tip of the device. However, such an arrangement has not heretofore been satisfactorily provided in portable electromagnetic pickup tools.

SUMMARY OF THE INVENTION

It is an objective to provide an improved magnetic pickup tool, which will negate the limitations and disadvantages of prior magnetic pickup tools while affording additional, and uniquely operational advantages as follows.

Limitation/disadvantage: difficulties related to maneuvering said magnetic tools.

Solution: the electromagnet can remain in an off state until it is close enough to secure the object.

Limitation/disadvantage: current recovery tools, including both, permeant magnets and electromagnetic types cannot retrieve nonferrous objects such as, aluminum or stainless steel bolts.

Solution: with the activation of the handle-mounted momentary switch the attachable gripping device can recover nonferrous objects.

Limitation/disadvantage: current recovery tools either do not have sufficient illumination or the ability to illuminate hidden areas.

Solution: the handle and distal end-mounted WIFI micro video camera are equipped with LEDs (Light Emitting Diodes).

Limitation/disadvantage: current devices do not have video cameras to provide enhanced search capabilities and/or inspection capabilities.

Solution: the device can have affixed to the distal end of said flexible shaft a WIFI micro video camera; which can be viewed via a cell-phone from a quick-connect holder on said tool's handle, whereas, said flexible shaft can be positioned by bending, and thus allow the viewing of otherwise hidden areas by said camera.

Limitation/disadvantage: current magnetic recovery tools are limited to specific lift/holding capacities.

Solution: the device can be configured to employ electromagnets of diverse lifting capabilities; dependent upon intended usage, such as automotive or heavy equipment maintenance.

EXAMPLE e1—an APW Company part # EMI 50-6-122 0.75" Dia. Electromagnet, 12 VDC, holding—6 lbs.

e2—an APW Company part # EMI 50-6-122 1.50" Dia. Electromagnet, 6 VDC, holding—66 lbs.

Limitation/disadvantage: consideration as to nearby objects must be taken before setting said current permanent magnet tools aside. Whereas, their magnetic fields can collect ferrous objects and/or corrupt electronic devices.

Solution: the invention is based upon an Electromagnet.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, its construction and operation, and many of its advantages should be readily understood and appreciated.

FIG. 6: Optional dual prong gripping arms.

DETAILED DESCRIPTION OF THE INVENTION

The invention consists of certain unique features and a combination of parts hereinafter fully described, illustrated in the accompanying drawings, and particularly pointed out in the appended claims, it being understood that various changes in the details may be made without departing from the spirit, or sacrificing any of the advantages of the invention.

The invention is a multifunctional, portable, (hand-held) electromagnetic pickup and inspection tool/device for the capture and recovery of ferromagnetic, and unique to the invention: the capture and recovery of non-ferromagnetic objects, from limited access locations, such as automotive engine bays. The viewing of said locations enhanced by, and, also unique to the invention, illumination from LEDs (Light Emitting Diodes) on the handle for wide area viewing and a WIFI micro-video camera with built-in LEDs for close viewing, mounted before said tool's electromagnet with said electromagnet mounted at the distal end of a flexible and hollow (gooseneck) shaft. The inverse end of said flexible shaft threads into the distal end of a rigid inner plastic telescopic shaft; which in turn is connected also by threads into an outer ridged telescopic shaft that is bonded to the tool's handle. The camera and flexibility of said shaft allowing for the viewing of hidden areas by a cell phone mounted on said tool's handle. The capture of said non-ferromagnetic objects, facilitated by an attachable, electromagnetically actuated gripping device. Said indigenous design device is also unique to magnetic pickup tools. A study of the six drawings provided should suffice to fully explain the device's construction.

A multifunctional, portable, (hand-held) electromagnetic pickup and inspection tool/device is provided for the capture and recovery of ferromagnetic, and unique to the invention: the capture and recovery non-ferromagnetic objects, from limited access locations, such as automotive engine bays. The viewing of said locations enhanced by, and, also unique to the invention, illumination from LEDs (Light Emitting Diodes) on the handle for wide area viewing and a WIFI micro-video camera with built-in LEDs for close viewing, mounted before said tool's electromagnet with said electromagnet mounted at the distal end of a flexible & hollow (gooseneck) shaft. The inverse end of said flexible shaft attached to the distal end of a rigid plastic telescopic shaft, that is connected by a bonding to said tool's handle. The Camera and flexibility of said shaft allowing for the viewing of hidden areas by a cell phone mounted on said tool's handle.

Figure 1:
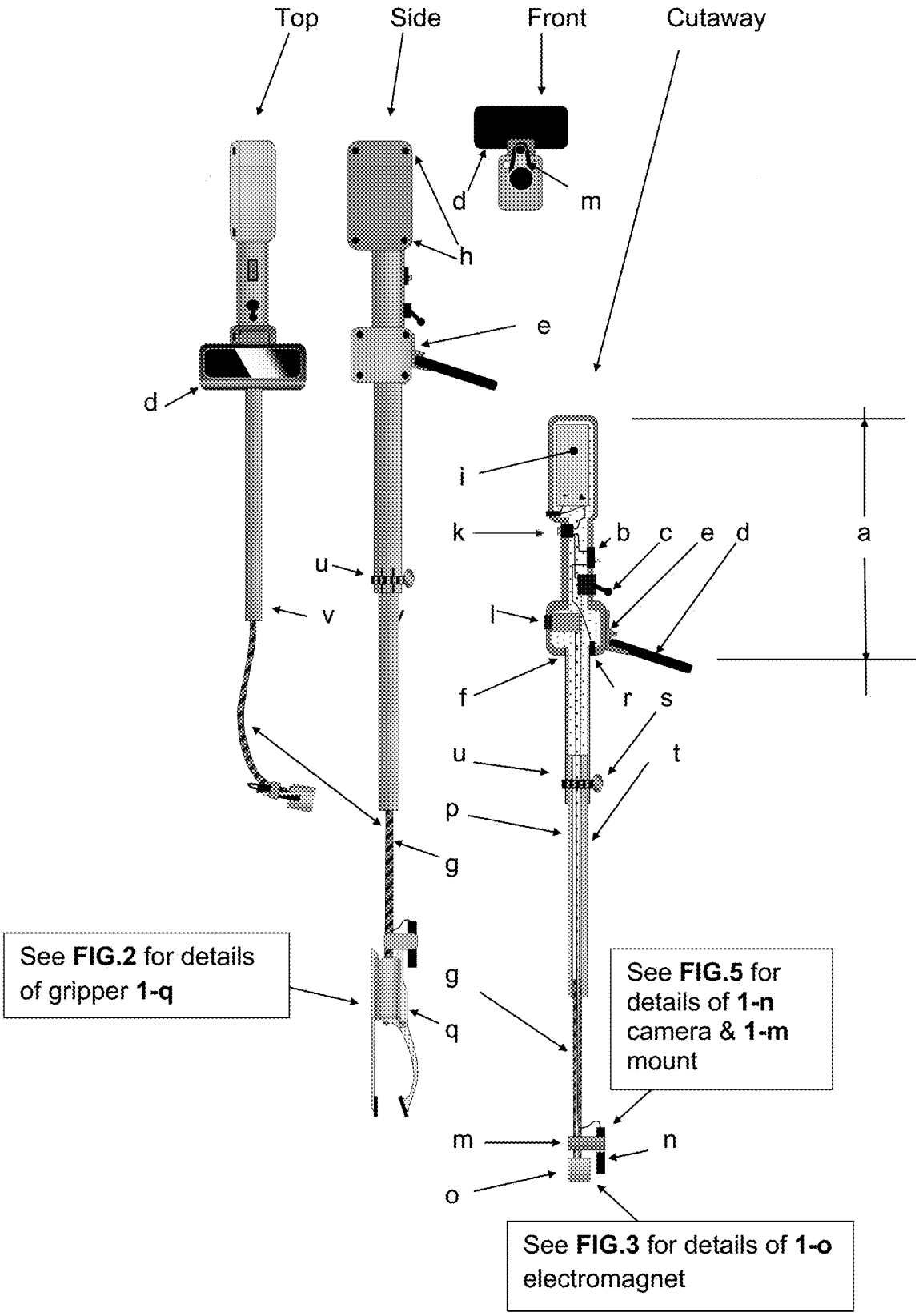
FIG. 1: Overall Conceptual Layout—with side, top and a side cutaway view.
Figure 3:
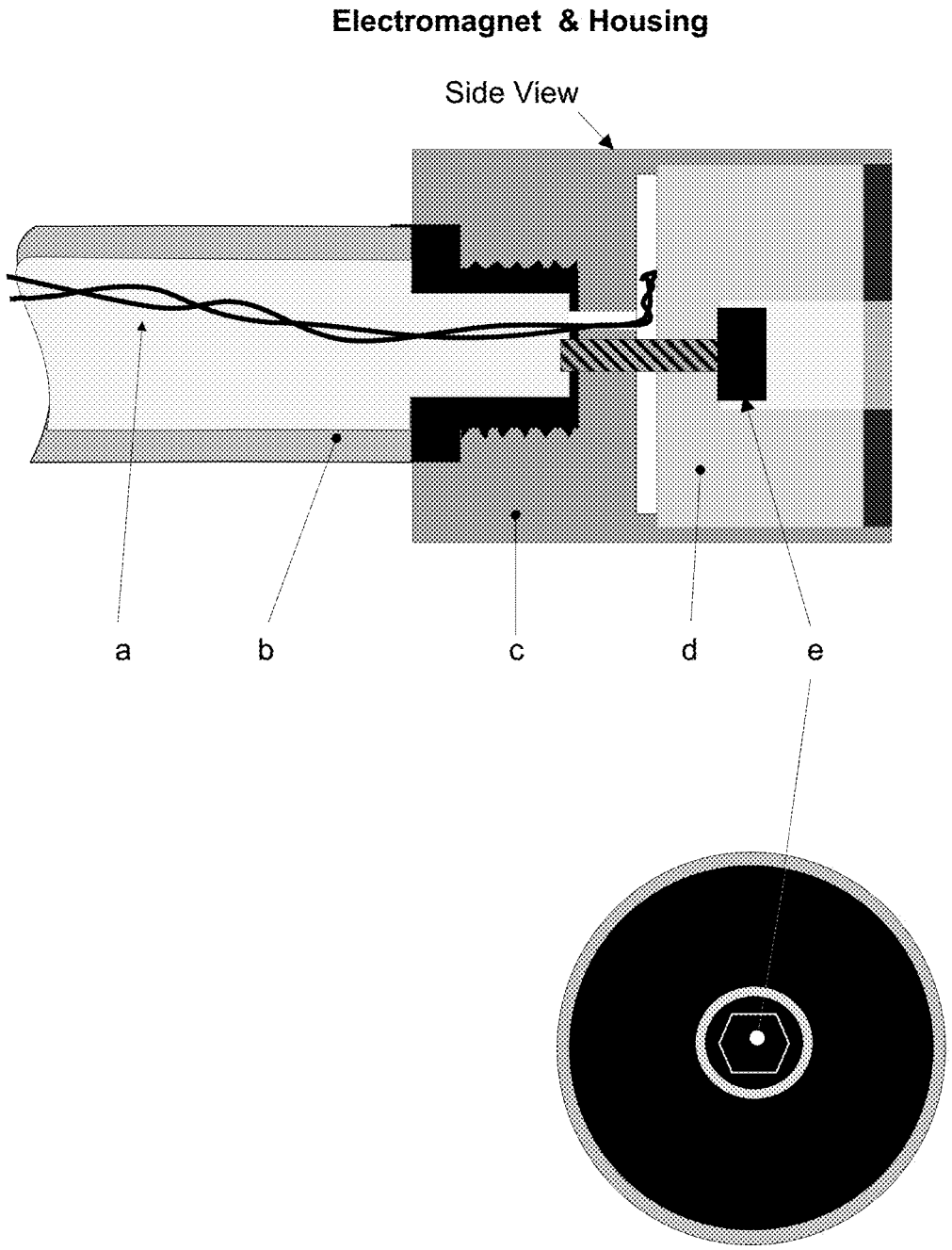
FIG. 3: Electromagnet and Housing cutaway view.

The capture of said non-ferromagnetic objects, facilitated by an attachable, electromagnetically actuated gripping device. Said indigenous design device is also unique to magnetic pickup tools. Comprising:

A plastic (PVC) and rigid telescopic outer shaft, FIG. 1, component u, with said shaft affixed to the tool's handle, FIG. 1, component f, by a bonding agent. Said shaft housing an inner PVC shaft, FIG. 1, component p. The distal end of which is tapped/threaded to accept the male threads of said hollow flexible shaft, FIG. 1, component g. The distal of said flexible shaft will thread into the electromagnet (FIG. 10) housing (FIG. 3).

1*a*—a rechargeable battery, FIG. 1, component I, 1*b*—a switch for said LEDs, FIG. 1, component b;

1*c*—a momentary trigger/switch, FIG. 1, component c, for the activation of said electromagnet;

1*d*—Cell phone, FIG. 1, component d, and cell phone mount, FIG. 1, component e;

1*e*—a recharging socket, FIG. 1, component j, for said battery;

1*f*—a cell phone, FIG. 1, component d.

A plastic handle, FIG. 1, component a, with a removable side, further comprising:

1*g*—a WIFI transmitter with a USB connector, FIG. 1, component L;

h—a reinforced mounting point, FIG. 1, component f, inclusive of a tapped/threaded hole for said flexible shaft;

1*i*—a fuse, FIG. 1, component k, for said battery.

Figure 5:
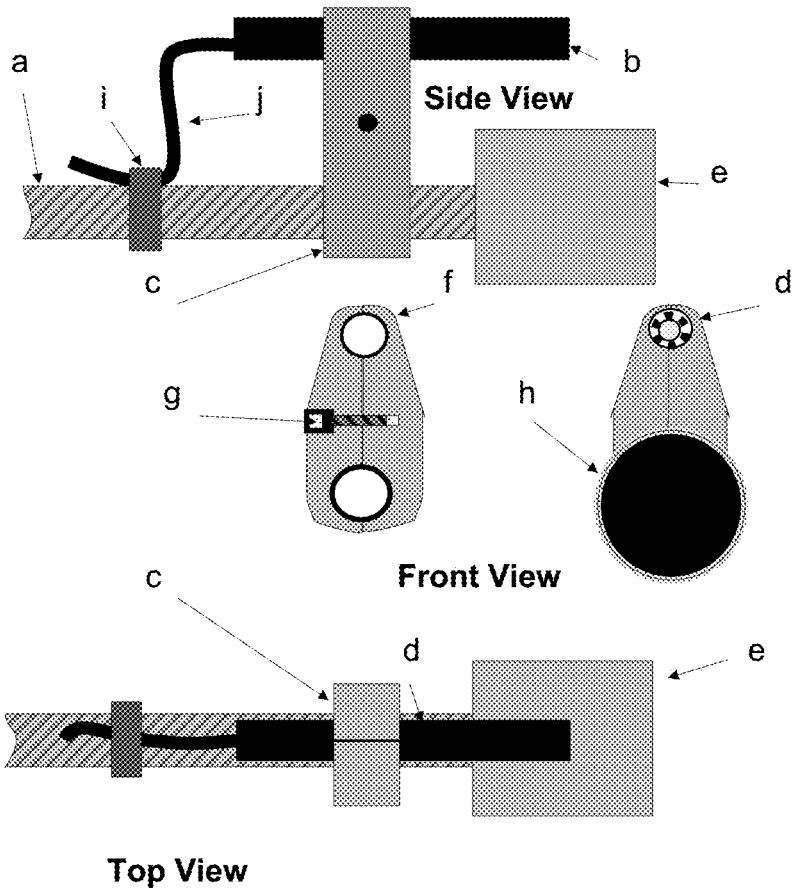
FIG. 5: Micro video camera and mount, top, side & front views.

A snap-in adjustable mount FIG. 1, component m, FIG. 5, for said micro video camera.

A 5 mm HD WIFI micro video camera with built-in LEDs FIG. 1, component n, FIG. 5, component b.

A cylindrical PVC housing FIG. 3, component c, for said tapped/threaded electromagnet having a hole for said flexible shaft and a tapped/threaded hole FIG. 6, component e, for said electromagnet mounting bolt.

Figure 2:
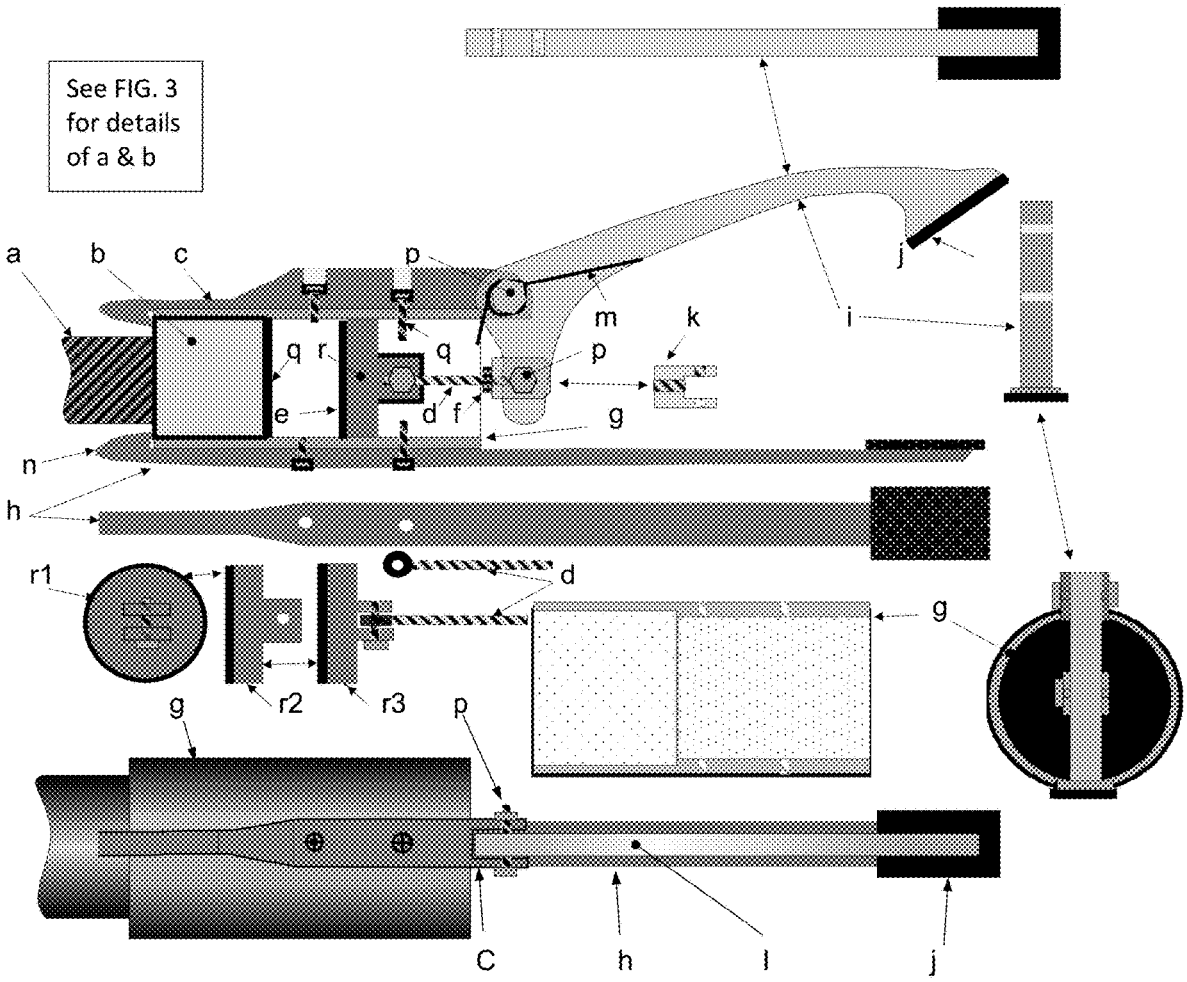
FIG. 2: Attachable Gripping device cutaway side view.
Figure 4:
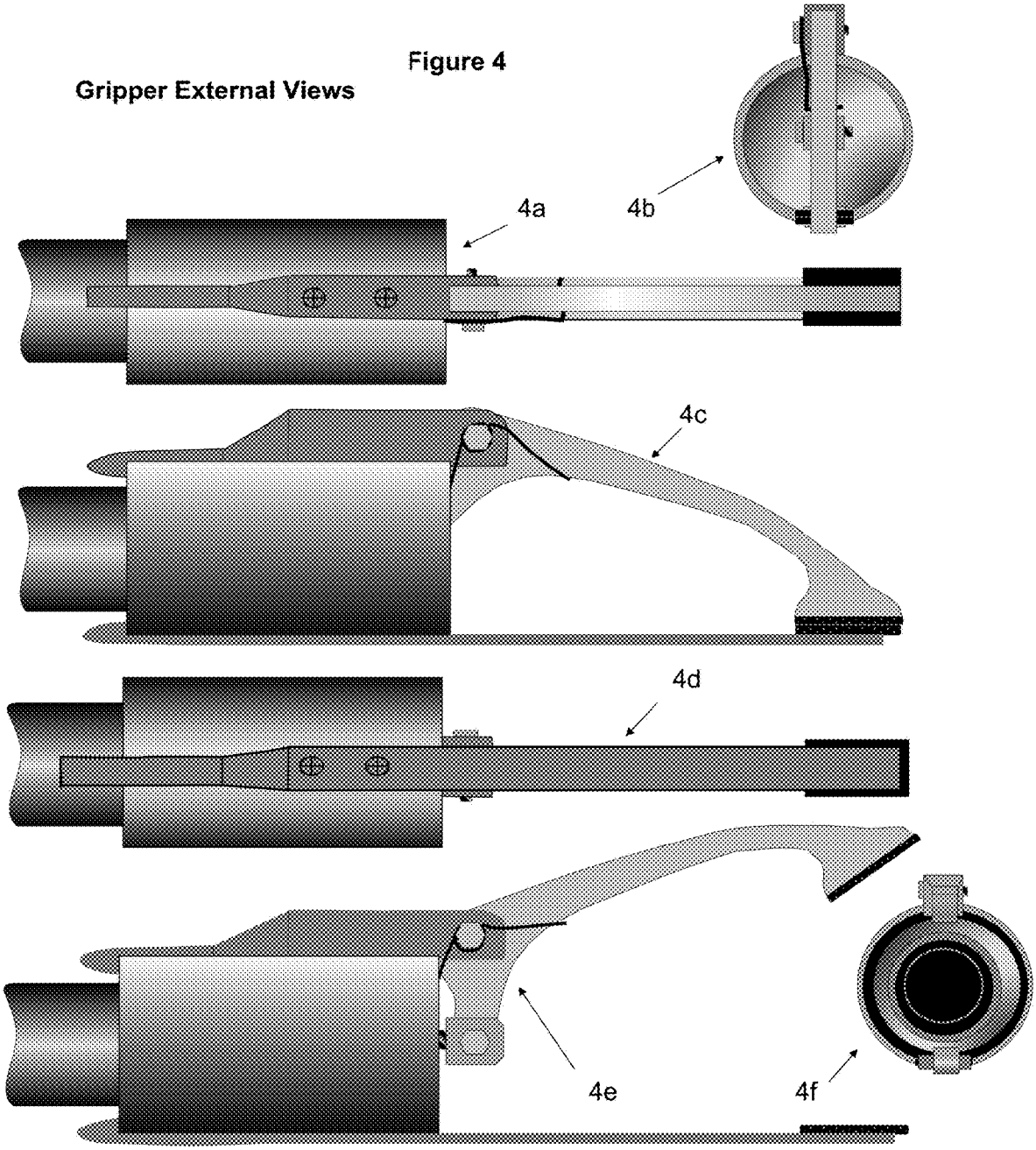
FIG. 4: Attachable Gripping device, front, rear, side, top and bottom views.

An attachable gripping device, FIG. 2, FIG. 4, FIG. 6, for the capture of said non-ferromagnetic objects, such as stainless steel, aluminum and plastics.

Further comprising:

5*a*—an outer electromagnet PVC housing/cylinder, FIG. 2, component g, FIG. 3, component c, for encasement of electromagnet housing, FIG. 1, component o;

5*b*—a electromagnetically actuated arm and interchangeable with other gripping arm types, FIG. 2, component I, such as (FIG. 6);

5*c*—a upper mount, FIG. 2, component c, with a pivot-point for said actuated arm, inclusive of a snap-in finger, FIG. 2, component n, for locking/retaining of said gripping device to the top of said electromagnet housing;

5*d*—a fixed arm, inclusive of a snap-in finger, FIG. 2, component n, for retaining said gripping device to the bottom of said electromagnet housing;

5*e*—a steel piston, FIG. 2, component e, enclosed in a PCV plastic cylinder, FIG. 2, component g, with said piston connected by a screw, FIG. 2, component d, to an adjustable pivot block, FIG. 2, component k, for activation of said arm, FIG. 2, component i, by electromagnet FIG. 2, component b;

5*f*—Rubber non-slip gripping pads at the distal end of said arms FIG. 2, component j, FIG. 2, component h, FIG. 6, component f;

a torsion spring, FIG. 2, component m, to hold said actuated gripping arm open when power to the electromagnet is off.

All electronic components will be connected with insulated and stranded wires; with those contained inside of said telescopic shafts, FIG. 1, component u, FIG. 1, component p, coiled to permit full extension and retraction of said shafts.

Note: with the exceptions of the adjustable aluminum pivot block, FIG. 2, component k, a hand-twist type hose clamp FIG. 1, component v, such as an Ideal Clamps, product #318-5Y02858, and the internal steel piston, the device (FIG. 1) will be manufactured from electrically nonconductive materials or insulated; to avert an accidental short circuit. Example: should said shafts contact live positive battery voltage.

What is claimed is:

1. An electro-magnetic retrieval, pickup, and inspection device comprising:

a handle connected to a telescopic shaft;

an electromagnet and a power switch for activation of the electromagnet;

a battery;

a micro video camera;

an LEDs and power switch for the LEDs;

a cell phone mount; and a gripping device comprising:

an outer electromagnet plastic housing/cylinder for encasement of an electromagnet housing;

an electromagnetically actuated arm comprising actuated and fixed arms;

non-slip gripping pads at an end of the actuated and fixed arms; and a spring to hold the actuated gripping arm open when power to the electromagnet is off.

2. The electro-magnetic retrieval, pickup, and inspection device of claim 1, wherein the telescopic shaft is rigid; and is connected to the handle by a bonding agent or by threads.

3. The electro-magnetic retrieval, pickup, and inspection device of claim 1, wherein the telescopic shaft comprises a flexible shaft attached to an end, with the electromagnet attached at or near an end of the flexible shaft.

4. The electro-magnetic retrieval, pickup, and inspection device of claim 1, wherein the telescopic shaft includes an outer shaft connected to the handle and an inner telescopic shaft, wherein an end of the outer shaft is tapped/threaded to accept male threads of the inner shaft.

5. The electro-magnetic retrieval, pickup, and inspection device of claim 1, wherein the power switch for activation of the electromagnet is a momentary trigger/switch.

6. The electro-magnetic retrieval, pickup, and inspection device of claim 1, wherein the handle comprises plastic and includes a removable side, the removable side further comprising:

a WIFI transmitter with a USB connector;

a reinforced mounting point including a tapped/threaded hole for the flexible shaft; and a fuse for the battery.

7. The electro-magnetic retrieval, pickup, and inspection device of claim 1, further comprising a snap-in adjustable mount for the micro video camera.

8. The electro-magnetic retrieval, pickup, and inspection device of claim 1, wherein the micro video camera is an HD WIFI video camera with built-in LEDs.

9. The electro-magnetic retrieval, pickup, and inspection device of claim 1, wherein the electromagnet is tapped/threaded and a cylindrical PVC housing for the tapped/threaded electromagnet comprises a hole for the flexible shaft and a tapped/threaded hole for an electromagnet mounting bolt.

10. The electro-magnetic retrieval, pickup, and inspection device of claim 1, wherein the gripping device further comprises an upper mount with a pivot-point for the actuated arm including a snap-in finger for locking/retaining the gripping device to the electromagnet housing.

11. The electro-magnetic retrieval, pickup, and inspection device of claim 1, wherein the gripping device further comprises a fixed arm including a snap-in finger for retaining the gripping device to the electromagnet housing.

12. The electro-magnetic retrieval, pickup, and inspection device of claim 1, further comprising a steel piston enclosed in a plastic cylinder, the steel piston connected by a screw to an adjustable pivot block for activation of the actuated arm by the electromagnet.

13. The electro-magnetic retrieval, pickup, and inspection device of claim 1, wherein the electromagnet, the power switch for activation of the electromagnet, the micro video camera, the LEDs, and the power switch for the LEDs are connected with insulated and stranded wires and contained inside of the telescopic shaft coiled to permit full extension and retraction of the shaft.

14. The electro-magnetic retrieval, pickup, and inspection device of claim 1, wherein the non-slip gripping pads comprise rubber.

* * * * *